US006991586B2

(12) United States Patent
Lapcevic

(10) Patent No.: US 6,991,586 B2
(45) Date of Patent: Jan. 31, 2006

(54) DATA STORAGE AND COMMUNICATION NETWORK FOR USE WITH EXERCISE UNITS

(75) Inventor: Thomas G. Lapcevic, Pittsburgh, PA (US)

(73) Assignee: Clubcom, Inc., Pittsburgh, PA (US)

( * ) Notice: Subject to any disclaimer, the term of this patent is extended or adjusted under 35 U.S.C. 154(b) by 85 days.

(21) Appl. No.: 10/682,598

(22) Filed: Oct. 9, 2003

(65) Prior Publication Data

US 2004/0127336 A1 Jul. 1, 2004

Related U.S. Application Data

(60) Provisional application No. 60/417,117, filed on Oct. 9, 2002.

(51) Int. Cl.
*A63B 21/00* (2006.01)

(52) U.S. Cl. ..... 482/8; 482/1; 482/9; 482/900

(58) Field of Classification Search ..... 482/1–9, 482/900–902

See application file for complete search history.

(56) References Cited

U.S. PATENT DOCUMENTS

| | | | | |
|---|---|---|---|---|
| 4,828,257 | A | | 5/1989 | Dyer et al. |
| 5,435,315 | A | | 7/1995 | McPhee et al. |
| 5,474,090 | A | | 12/1995 | Begun et al. |
| 5,717,923 | A | | 2/1998 | Dedrick |
| 5,724,521 | A | | 3/1998 | Dedrick |
| 5,740,549 | A | | 4/1998 | Reilly et al. |
| 5,887,133 | A | | 3/1999 | Brown et al. |
| 5,888,172 | A | | 3/1999 | Andrus et al. |
| 5,995,943 | A | | 11/1999 | Bull et al. |
| 6,006,257 | A | | 12/1999 | Slezak |
| 6,029,045 | A | | 2/2000 | Picco et al. |
| 6,059,692 | A | | 5/2000 | Hickman |
| 6,122,658 | A | | 9/2000 | Chaddha |
| 6,298,218 | B1 | | 10/2001 | Lowe et al. |
| 6,312,363 | B1 | | 11/2001 | Watterson et al. |
| 6,345,293 | B1 | | 2/2002 | Chaddha |
| 6,645,124 | B1 | * | 11/2003 | Clem ..... 482/4 |
| 6,827,669 | B2 | * | 12/2004 | Cohen et al. ..... 482/8 |
| 6,827,670 | B1 | * | 12/2004 | Stark et al. ..... 482/9 |

OTHER PUBLICATIONS

CSAFE. Communications Specification for Fitness Equipment, Jun. 10, 2002, downloaded from www.fitlinxx.com.
The Fitness Advisor Network, Nautilus, Oct. 9, 2002, downloaded from www.fitnessadvisor.com.
FitLinxx Online, Oct. 9, 2002, downloaded from www.fitlinxx.com.

* cited by examiner

*Primary Examiner*—Glenn E. Richman
(74) *Attorney, Agent, or Firm*—Metz Lewis LLC

(57) ABSTRACT

A system for simultaneously capturing data from multiple sources from individuals training on exercise equipment is provided. The system utilizes a wireless means of either transferring data to a computer server for permanent storage and interactive analysis or to prompt the delivery of programming content or data from a computer server to the exercise units or attachments affixed thereto. The system also includes an interactive means of incorporating third-party input regarding additional characteristics about each exercise unit, entertainment system or human user that when integrated with the base line equipment data becomes highly relevant and valuable. The present invention utilizes a programmable transceiver that can receive entertainment programming and data communications from a central computer server while simultaneously receiving data from multiple devices attached to or integrated within the exercise unit.

1 Claim, 1 Drawing Sheet

DATA STORAGE AND COMMUNICATION NETWORK FOR USE WITH EXERCISE UNITS

CROSS REFERENCE TO A RELATED APPLICATION

This application claims the benefit of U.S. Provisional Application No. 60/417,117 filed on Oct. 9, 2002.

FIELD OF THE INVENTION

The present invention is directed generally to a system of collecting, transferring and applying information gathered from exercise equipment.

DESCRIPTION OF BACKGROUND

There has been an ongoing initiative within the fitness equipment industry to establish standards for capturing and storing data generated by electronic components attached to, integrated within or communicating with exercise equipment. For example, with respect to cardiovascular training equipment, manufacturers have adopted a programming protocol known as C-SAFE (Appendix A) in an effort to establish an industry-wide standard. The C-SAFE protocol captures various types of data regarding the operation and utilization of the equipment as outlined in the attached Appendix A. Unfortunately, it has proven to be very impractical and expensive to transfer, compile and apply such data. In addition, in order for such equipment data to be meaningful, it must be integrated with other data including human, operational, and logistical data and various other forms of information and programming content.

Systems currently exist that transfer exercise equipment data back to a computer storage server that then permits the data to be retrieved via the Internet or through other methods. For example, certain approaches connect wires from the exercise unit to a computer. Other approaches provide for a wireless transmission of the data from the exercise unit to a computer. In each case, however, the transmission means are cumbersome, unreliable or prohibitively expensive for mass scale deployment. In addition, there are no back-end integration capacities or methods that integrate the baseline equipment data into practical applications.

There are also systems attached to exercise equipment that receive wireless transmission of audio entertainment that permit users to selectively listen to different entertainment options. These systems consist of a basic receiver chip that can receive transmission at different frequency levels such 900 megahertz or 2.4 gigahertz. Some companies, such as CardioTheater, have inserted programmable chips into such receivers in order to have the capacity to communicate with C-SAFE compliant exercise units. Such receivers, however, typically do not have the capacity of communicating the C-SAFE data or its own data back to a central computer. In addition, certain companies, such as CardioTheater, provide personal viewing entertainment screens that attach to and can communicate with C-SAFE compliant exercise units.

In addition, certain companies, such as Polar, have built into cardiovascular training equipment units a receiver chip that can receive communications from a wireless heart rate strap that monitors the heart rate of an individual as he or she exercises on the unit. The user's heart rate is typically displayed on a digital monitor incorporated into the exercise unit.

Thus, there have been many efforts to capture and display data relating to equipment, human and entertainment information gathered while individuals exercise on electronically integrated exercise units. In addition, there have been efforts to deliver elective entertainment programming options to individuals as they exercise on cardiovascular training units. There exists a substantial need, however, to collect, transfer and apply such information for practical applications in an efficient and reliable manner.

SUMMARY OF INVENTION

The present invention is directed to a system of simultaneously capturing data from multiple sources while individuals train on exercise equipment and using a wireless means of either transferring such data to a computer server for permanent storage and interactive analysis or to prompt the delivery of programming content or data from a computer server to the exercise units or attachments affixed thereto. The system also includes an interactive means of incorporating third-party input regarding additional characteristics about each exercise unit, entertainment system or human user that when integrated with the base line equipment data becomes highly relevant and valuable. The present invention utilizes a programmable transceiver that can receive entertainment programming and data communications from a central computer server while simultaneously receiving data from multiple devices attached to or integrated within the exercise unit. The transceiver can be remotely programmed to receive, store and transfer such data pursuant to a wireless communication to a central server. The present invention provides a data-matching interface pursuant to which users define the type of data they want summarized and provide additional data and/or profiles for integration with the baseline equipment data for dynamic and ongoing analysis.

BRIEF DESCRIPTION OF THE DRAWINGS

For the present invention to be clearly understood and readily practiced, the present invention will be described in conjunction with the following figures wherein.

Figure 1:
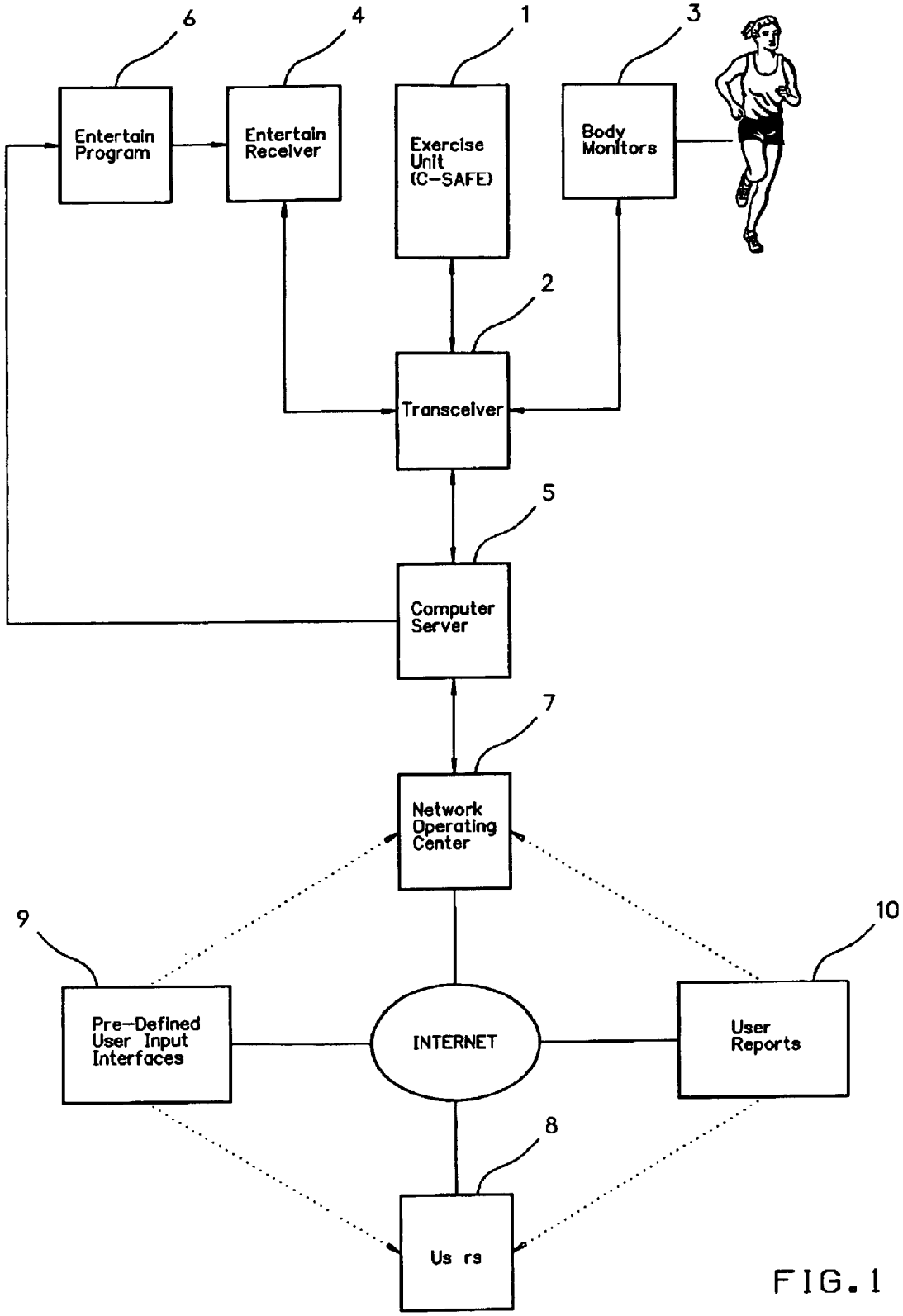
FIG. 1 represents an embodiment of a cardiovascular exercise unit integrating the C-SAFE protocol standard.

Item 2 of FIG. 1 represents an embodiment of a programmable transceiver that is either integrated into or attached to the exercise unit through a wired connection, such as a serial port, or a wireless connection, such as RF or infrared;

Item 3 of FIG. 1 represents an embodiment of a body-monitoring device attached to an individual during exercise that is integrated with a programmable transceiver or is directly connected to the exercise unit through a wired connection, such as a serial port, or a wireless connection, such as RF or infrared;

Item 4 of FIG. 1 represents an entertainment and data receiver unit that is embodied within a user enabling device that is either is coordinated with or uses the functionality of the programmable transceiver;

Item 5 of FIG. 1 represents an embodiment of a computer server with a programmable transceiver that is integrated with the computer server through a wired connection, such as a serial port, or a wireless connection, such as RF or infrared;

Item 6 of FIG. 1 represents entertainment or educational programming content delivered to the entertainment receiver;

Item 7 of FIG. 1 represents a computer network-operating center that is connected to the computer server via a phone line or broadband connection;

Item 8 of FIG. 1 represents user interfaces that are connected to the central network-operating center via the Internet; and Item 9 of FIG. 1 represents reports generated from the integration of the output from the exercise unit and the user input.

DESCRIPTION OF THE PREFERRED EMBODIMENTS

FIG. 1 is a diagram illustrating an electronically integrated cardiovascular exercise unit that has some form of generating and storing data such as the C-SAFE protocol, including the capacity for a user of the exercise unit to input personal identification codes. Such exercise unit is integrated with a programmable wireless transceiver (item 2) that is capable of storing data and having two-way communications with the exercise unit (item 1) as well as other electronic devices such as wireless heart strap monitors (item 3) and entertainment receivers (item 4). The transceiver (item 2) also has the capability of having two-way wireless communications with a computer server (item 5) that is integrated with a compatible wireless transceiver. The transceiver (item 2) also has the capacity to receive incoming entertainment programming (item 6) and data transmissions from a computer server (item 5). The transceiver (item 2) is programmed in such a manner to capture, encrypt and package data in a systematic manner and conducting coordinated transmissions to other compatible devices and the computer server (item 5) such to avoid conflict with incoming data and entertainment signals.

The computer server (item 5) is connected via a phone line or broadband connection to a central network-operating center (item 7). The computer server (item 5) is capable of storing data together with entertainment and educational audio/video programming content and initiating two-way communications with the transceiver (item 2) and programming content downloading with the entertainment receiver (item 4). The computer server (item 5) is also capable of receiving entertainment and programming content from the central network-operating center (item 7) and conducting two-way communications of data with the same. The computer server (item 5) is capable of gathering, processing, coordinating and transferring incoming data from the transceiver (item 2) and the central network-operating center (item 7) so as to serve as a communication and intelligence link between the two devices.

The central network-operating center (item 7) serves as a central information hub by integrating data collected and transmitted from the computer server (item 5) with inquiries and data input transferred via the Internet from multiple users (item 8) utilizing coordinated pre-defined interfaces and query fields (item 9). The central network-operating center (item 7) further serves as a central communications hub by receiving and initiating the transfer of data, programming content and reports to and from the computer server (item 5) and multiple users (item 8) through the pre-defined user input interfaces (item 9). This is intended to result in both the pull and push of desired data and content by and between the network operating-center (item 7) and computer server (item 5) on one hand and the network operating-center (item 7) and multiple users (item 8) using the interfaces (item 9) and reports (item 10) on the other. Overall, the central network-operating center (item 7) will be able to push data and programming content through the computer server (item 5) and to the transceiver (item 2) and control the functions of all devices communicating with the transceiver (item 2) such as the exercise unit (item 1), the entertainment receiver (item 4), the human body monitors (item 3) and any other integrated devices capable of receiving commands. At the same time, the central network-operating center (item 7) will be able to push data to the multiple users (item 8) based upon input and inquiries received via the pre-defined user input interfaces (item 9).

There are multiple users (item 8) of the overall data network. In each case, however, supplemental data is necessary to be integrated with the underlying generic or raw data (e.g., C-SAFE) to make certain outputs meaningful for specific applications such as equipment performance and utilization assessments, training regiments and protocols, customized programming content, e-commerce initiatives and other user specific applications. To facilitate this convergence of data, multiple users (item 8) will be provided multiple pre-defined user input interfaces (item 9) that permit an efficient cataloging and management of C-SAFE type data with additional data fields that are unique to the exercise unit (item 1) such as brand identity of the exercise unit (item 1.), the product category of the exercise unit (item 1) (e.g., treadmills, ellipticals, bikes, steppers, etc.) logistical factors related to the exercise unit (e.g., the row the unit is in or the relative window location), environmental factors (e.g., a humid environment), user identification data that integrates information unique to the user of the exercise unit (e.g., age, gender, training regiments, body monitoring factors) and other correlated information that users would deem useful. In essence, equipment, human and programming profiles are created and integrated with the underlying equipment data. Such supplemental data can be provided by the ultimate user of the data or by authorized third parties. The efficient convergence of all such data can facilitate valuable applications by many different users.

One set of significant users of the data networks is expected to be the manufacturers of the exercise units (item 1) to conduct remote diagnostic assessments and repairs, programming updates, product utilization research, durability assessments and other forms of data applications. For such applications to be practical and meaningful, such users will be provided a user interface (item 9) that captures and transfers to the central network-operating center (item 7) the type of information that is relevant to the manufacturer with respect to the specific exercise unit (item 1) being analyzed. The user interface (item 9) will enable the manufacturer to add various forms of supplemental information that makes the application of the baseline data generated by the exercise unit (item 1) and C-SAFE meaningful. For example, environmental factors such as humidity will have a significant impact on the operation of the exercise unit (item 1). The user interface (item 9) will permit the manufacturer or a third-party to add such environmental information and assign it to the given exercise unit (item 1). As a result, future assessments of the operation of the exercise unit (item 1) and reports (item 10) generated thereby will be meaningful and accurate. It can be understood that any type of unit specific information may be identified, indexed and assigned to any specific exercise unit (item 1) to assist in the assessment and reporting process. The network operating center (item 7) can also be programmed to send automatic notifications to manufacturers for specific exercise units (item 1) regarding possible operational problems as indicated by certain data that is captured within the unit such as an excessive use of electricity or other problem indicators. Such recommendations can be sent to the user interface (item 9) or though e-mail notifications.

Health club operators that purchase and install exercise units will find data related to the utilization and maintenance of the exercise units of significant value. These applications can include the assessment of utilization of specific exercise units (item 1) by health club members at different times of the day and in different locations within the club in order to determine whether additional units are needed to satisfy member demand and which types or styles of equipment are preferred. The health club operator could even determine the preferred layout of the equipment and when to rotate the location of excessively used units with less used units to prolong the useful life of the units. This is significant considering that the physical location of the equipment can significantly impact user preferences such as in the case of exercise units situated in the first row or in front of a window with a view, etc. The health club operator could also determine which units are more durable based upon the comparison of maintenance information and user hours pulled from C-SAFE data of a specific exercise unit (item 1). For such applications to be practical and meaningful, health clubs will be provided a user interface (item 9) that captures and transfers to the network-operating center (item 7) the type of information that is relevant to the health club operators with respect to the specific exercise unit (item 1) being analyzed. The user interface (item 9) will enable the health club operator to add various forms of supplemental information that makes the application of the baseline data generated by the exercise unit (item 1) and C-SAFE meaningful. For example, the location of an exercise unit (item 1) and other environmental factors such as the presence of a personal viewing screen or wall-mounted television could have a significant impact on the utilization and corresponding useful life of the exercise unit (item 1). The user interface (item 9) will permit the health club operator or authorized third-parties to add such logistical and environmental information and assign it to the given exercise unit (item 1). As a result, future assessments of the utilization and maintenance of the exercise unit (item 1) and reports (item 10) generated thereby will be meaningful and accurate. It can be understood that any type of unit specific information may be identified, indexed and assigned to any specific exercise unit (item 1) to assist in the assessment and reporting process. The network operating center (item 7) can also be programmed to send automatic recommendations to health club operators for certain subject areas such as when to rotate equipment or purchase additional equipment based upon the overall relative utilization of exercise units within a given facility. Such recommendations can be sent to the user interface (item 9) or though e-mail notifications. As an example, these recommendations could be based upon statistical analysis comparing actual equipment utilization with manufacturer's warranties and making recommendations thereon to maximize warranty coverage.

Health care professionals and personal trainers that train individuals utilizing exercise units could provide significant value to clients who utilize exercise units (item 1) that are integrated with the network data platform. These applications can include accessing the pre-defined user interface (item 9) to define training regiments and protocols for clients based upon the trainer's assessment of the client and the perpetual monitoring of the client's exercise performance as tracked by the application of C-SAFE data and corresponding human response data as monitored by human body monitors. By converging this information, a trainer can assess whether the client is ready to progress to a more advanced training level based upon the integrated assessment of the client's exercise performance and corresponding physiological response. Training regimens can be pre-set by trainers based upon pre-defined categories of clients, such as categories that take into account age, gender, overall physical readiness and medical condition, or the trainer can perpetually monitor and define new training regiments for each client. In either case, the trainer can establish the performance and human response targets that form the basis of an overall training regiment. Exception reports can be automatically generated by the network-operating center (item 7) and delivered to the trainer. For example, the trainer may determine that a client cannot progress to the next training level if that client's heart rate exceeds a certain level during the previous exercise session despite the fact that the client successfully completed the session. If the client satisfies all of the requirements defined by her trainer, the client will automatically advance to the next training level. If the client fails to satisfy a requirement, the network-operating center will automatically notify the trainer and the trainer can elect to become involved or have the client follow an automatic default regiment. In all cases, the equipment will automatically set itself for the individual client by applying C-SAFE instructions when the client inserts her individual identification code or through a wireless communication device that is unique to the client, such as a body monitoring device (item 3), and compatible with the transceiver (item 2). Such virtual training and monitoring is only possible through the convergence of the equipment data (exercise performance) and physiological data (body monitoring devices) with supplemental data provided by a training expert. Reports can be routinely generated by the network-operating center (item 7) to support reimbursement payments by third parties such as insurance companies. The health club professional and trainer will also be able to use the user interface (item 8) to define entertainment, motivational and education programming content for a specific client though the delivery of customized content to the entertainment receiver (item 4). In such cases, the trainer can select from a pre-defined menu of programming content and select that content that the trainer deems to be best suited for a given client. For example, if the client is a smoker and is also prescribed certain medication, the health care professional or trainer can access the user interface (item 9) to activate programming content (item 6) that addresses the adverse physiological effects of smoking especially when taking the given medication. Such activation will prompt the computer server (item 5) to deliver the specified content (item 6) to the entertainment receiver (item 4) when the user's identification code is inserted or wirelessly received by the exercise unit (item 4) at the beginning of the client's exercise session. The client will not be able to change the entertainment programming (item 6) when such programming is an integrated component of a training or rehabilitation protocol. As such, there is an overall assurance that the client is being simultaneously trained, monitored and educated.

Each individual user of an exercise unit (item 1) will be able to access his unique pre-defined user input interface (item 9) to define his personal training regiments and physiological monitoring perimeters in the same way available to health care professionals and personal trainers as detailed above. In addition, individuals will be able to access the input interface (item 9) and categorically define the type of entertainment and educational programming (item 6) he wants to watch or listen to through the entertainment receiver (item 4) based upon the programming offering available through the computer server (item 5). For example, if a user prefers top 40 music blended with country hits and at the same time wants to learn about the benefits of circuit training, the user would simply activate the corresponding programming bins on the input interface (item 9) and conforming programming content (item 6) will be systematically delivered to the entertainment receiver (item 4) when the user inserts his personal identification number into the exercise unit (item 1). The result is a motivating and completely customized training and entertainment experience.

Advertisers desiring to communicate with users of the exercise unit (item 1) will be provided a user input interface (item 9) that can integrate advertising messages or interactive queries and surveys into the programming content (item 6) based upon a matching of content with individual user characteristics. Such matching may be based upon the characteristics of a specific individual as determined by an individual's personal identification code and a corresponding individual profile or survey, or upon general factors such as the nature of the training facility, the time of day or even the nature of the programming content (item 6) being listened to or watched. In all cases, advertisers will be provided a report that precisely defines the number impressions through a pre-defined segmentation of pertinent viewer information. Advertisers can even prompt users of the exercise unit (item 1) to respond to queries, surveys and even to purchase products by interacting with the user input and response capabilities of the entertainment receiver (item 4) or the control panel of the exercise unit (item 1). In such cases, the advertisement content inserted into the programming content (item 6) can drive a user response. For example, a user interested in being able to purchase products while exercising on exercise units (item 1) could access her personal user input interface (item 9) and pre-establish a purchasing profile by providing the financial information needed to conduct e-commerce transactions, such as her credit card information and authorization, establish a secret password that corresponds to her unique user identification code, and define her ship to address. This information is then stored through a protected manner within the network-operating center (item 7). Thereafter, each time the user is in a facility training on an exercise unit (item 1) she has already established her profile that enables her to efficiently effectuate e-commerce transactions through the exercise unit (item 1) or entertainment receiver (item 4). To illustrate the overall operation, an advertiser interested in targeting women for the virtual distribution of a given product may have an advertisement promoting the product inserted into the programming content (item 6) each time a woman accesses an exercise unit (item 1) as established by a user inserting her personal identification code. The advertisement could inform the woman that the product is available for sale simply by inserting her previously assigned password and entering a designated product code into the control panel of the exercise unit (item 1) or the entertainment receiver (item 4). The data effectuating the transaction is then bundled, encrypted and stored on the transceiver (item 2) and transferred to the computer server (item 5) and subsequently transferred to the network-operating center (item 7). The network-operating center (item 7) then compiles and analyzes the data in a secured manner and matches the input data supplied from the equipment with the user's previously defined customer profile. Relevant data is then forwarded by the network-operating center (item 1) to the advertiser/e-retailer to effectuate the transaction. It may be desirable to have a holding period of a defined length before the transaction is transferred by the network-operating center (item 7) so as to provide the user the opportunity to access her user input interface (item 9) when she returns home from the training facility and approve, cancel or otherwise modify the transaction she commenced through the exercise unit (item 1) before being fully processed. Overall, this model provides an integrated convergence of promotional broadcasts and immediately accessible purchasing capacity targeting a specifically targeted customer base.

What is claimed is:

1. A data storage and communication network for the control and operation of an exercise unit, comprising:

an exercise unit adapted for electronic communication of user status, unit status, and unit operational information;

a central information processing system in electronic communication with said exercise unit, said communication being secure from unauthorized interference;

at least one first data storage means associated with said processing system adapted to receive status and identity information relating to a unique user of said exercise unit;

at least one second data storage means associated with said processing system adapted to receive status and operational information relating to said exercise unit;

first data output means for the selective display of said user status information; and second data output means for the selective display of said exercise unit status and operational information.

* * * * *